US006015064A

United States Patent [19]

Liu

[11] Patent Number: 6,015,064

[45] Date of Patent: Jan. 18, 2000

[54] PORTABLE CLOSABLE CONTAINER WITH INDIVIDUALLY CLOSABLE CELLS

[75] Inventor: Gang Liu, Novi, Mich.

[73] Assignee: Analog Technologies, Inc., Novi, Mich.

[21] Appl. No.: 08/996,860

[22] Filed: Dec. 23, 1997

[51] Int. Cl.[7] ..... B65D 1/24; B65D 85/42

[52] U.S. Cl. ..... 220/524; 206/372; 206/511; 206/725

[58] Field of Search ..... 220/524, 523, 220/507, 337–339, 902; 206/511, 725, 372, 459.5; 190/111, 109

[56] References Cited

U.S. PATENT DOCUMENTS

| | | | |
|---|---|---|---|
| 1,095,744 | 5/1914 | Smith | 220/524 |
| 1,610,146 | 12/1926 | Panzer | 190/109 |
| 2,145,143 | 1/1939 | Trecartin | 220/338 |
| 3,415,407 | 12/1968 | Alden et al. | 206/459.5 X |
| 3,499,525 | 3/1970 | Kanter | 220/339 X |
| 4,090,606 | 5/1978 | Dawson | 206/459.5 X |
| 4,863,062 | 9/1989 | Wilkinson et al. | 220/507 X |
| 4,887,790 | 12/1989 | Holliday | 220/338 |
| 5,379,887 | 1/1995 | Conley | 220/523 X |
| 5,390,787 | 2/1995 | Macasaet | 220/524 X |

FOREIGN PATENT DOCUMENTS

| | | | |
|---|---|---|---|
| 779120 | 2/1968 | Canada | 220/524 |
| 935136 | 8/1963 | United Kingdom | 220/507 |

OTHER PUBLICATIONS

Photograph A showing view of prior art container.
Photograph B showing view of prior art container.
Photograph C showing view of prior art container.
Photograph D showing view of prior art container.
Photograph E showing view of prior art container.
Photograph F showing view of prior art container.
Photograph G, H & I showing views of prior art container.

*Primary Examiner*—Bryon P. Gehman
*Attorney, Agent, or Firm*—Harness, Dickey & Pierce, P.L.C.

[57] ABSTRACT

A portable closable container has individually closable cells under a main lid. The container has a base with which the main lid defines an internal space. The internal space is partially filled by a plurality of side-by-side, top-to-bottom individual cells. Each of the cells is fitted with a removable cover which is hingedly mounted to the cell. The removable cover of the cell includes a tab for manipulation by the user's finger. A space is provided for a label on the cover of the cell. The components of the container are preferably composed of a polymerized material, such as polypropylene. There are two slots on the main lid which match the two feet on the base. These slots and the feet allow one container of the same kind to be stacked on the top of another without one shifting with respect to the other away from each other.

22 Claims, 13 Drawing Sheets

PORTABLE CLOSABLE CONTAINER WITH INDIVIDUALLY CLOSABLE CELLS

BACKGROUND OF THE INVENTION

1. Field of the Invention

The present invention relates in general to hand-portable molded plastic closable, resealable containers for storing multiple pieces of several different objects of the same general kind, and in particular to lightweight, easily transported, robust, molded plastic storage containers with repeatedly closable covers fitted to a plurality of individual cells for storing several dozen or more different objects of the same general size and type, such as surface mount resistors of different values, in a single container, while permitting them to be readily supplied or removed from any given cell.

2. Discussion

Presently, collections of like miniature electrical components such as surface mount resistors ("SMRs") and surface mount capacitors ("SMCs"), are marketed in a variety of different forms. For example, SMRs of the 5% tolerance type have approximately 120 different values. The occasional user represented by the typical "hands-on" engineer, technician, professor or serious hobbyist prefers to have immediately available a full set of surface mount devices, i.e., at least several to several dozen of each value.

At present, the surface mount resistors are provided by their manufacturers to their customers in a variety of classic packages. One known way of packaging, shipping and storing the surface mount components is to package them in the familiar see-through flexible plastic bags made of a thin film of polyethylene or like plastic sheet. However, the typical bag, once opened, cannot be resealed. Even the plastic bags having a resealable closure mechanisms are not all that convenient, and do not always work as intended. The failure of known packages is particularly evident in the case of small surface mount components, since they could become accidentally lodged in the zipper (or other closure) of the bag during an attempted closing. Further, an amorphously shaped bag is an inconvenient way to store and access the components repeatedly over a lengthy period of time. Such bags do not stack well, and they can be punctured relatively easily. Thus, the typical user, such as a laboratory technician, may well want to reload small components package in such polyethylene bags into yet another container, such as the familiar plastic pill bottle with its removable cap, for long-term storage, so that they can be easily accessed from time to time as needed.

A second packaging technique is to have the surface mount components stuck on a roll or reel of tape. The tape typically has three layers: The base layer, which is made of thin paper; the middle layer, which is made of the paper thicker than the components; and the top layer, which is made of thin transparent plastic film. The base layer holds the components, the middle layer has cut rectangular windows for housing the components, and the top layer stops the components from coming out the middle layer and provides transparent windows for reading the value marks on the components if there are any. The top layer can be peeled off to reveal as many surface mount components as desired at one time. Typically, such reels of the tape hold 1,000 or 5,000 identical components, and are prepared at the manufacturer's factory. Accordingly, even one such tape reel provides a much larger amount of components than the typical technician, engineer, professor, hobbyist or other occasional user would ever wish to experiment with. Locating the right reel among one hundred plus of them and peeling off the top layer to unload the components is not convenient. Loading back unused components is impossible.

One company, namely CRCW of Norfolk, Nebraska, sells these reels of tape to customers through the Allied Electronics sales catalog (a nationwide mail order electronics parts catalog). CRCW provides 1,000 identical components on a single reel of tape and 100 reels in a set. However, the users of such reels of tape still have a significant storage problem because they must provide shelf space for the storage of 100 reels of tape, one for each of the 100 resistor values.

A third packaging technique for surface mount components involves little plastic bottles with individual covers. These bottles or vials of components are also sold in lots of 5,000 or 10,000. This is far more than any person who is even a very serious occasional user would need for an individual component value. Only in a production situation would it be likely that so many components would be required, and in that situation only the components of certain values required will be ordered for the planned production runs. Assembling such a great quantity (at least 100) of bottles together requires a large space and locating the right one as needed is not convenient.

A fourth known way of storing these components is the use of a cassette of components. These thin tape-like cassettes (like the familiar audiotape cassettes) are used for special pick-and-place automated equipment frequently used by manufacturers of circuit boards and the like. These cassettes of surface mount components are useful in that they are so designed as to feed one component to an automated machine which will pick up the component and place it on a printed circuit board for subsequent automated soldering. However, these cassettes are necessarily expensive (since they contain a large number of components, usually over 5,000 pieces), and again present problems of storage, since storing over 100 of them takes a fair amount of space, as do the individual vials or reels of tape, and inconvenient access.

In addition, the typical occasional user will want to organize his electrical components, which requires both labels and shelf space for all of the bags or containers such as vials, so that they are easy to access when needed. Providing appropriate labels, and creating an easy-to-read, well-organized system for storage in order for the components to be handy and readily available when needed represents extra work for the user. A typical user, in his workshop or lab, may provide a shelf of storage bins with compartments therein, or large cabinets with door having shelves therein. To gain access to given component value, such a user would in fact have to open the door, find the right bin or tray, pull out the appropriate container, open the container, pick up the surface mount component within the vial or reel that he wishes to use, and then return the container to its place on the shelf or in the bin or tray, and then shut the door to the cabinet from which it came. Such a multi-step process to access a specific component is time-consuming and not convenient, especially to a user working at an already-crowded workbench.

The storage and access problems are worse for the user who travels about and wishes to take with him all of the different containers so that he will have all of the different component values available to him at another site. Consider the electronics trouble-shooter who is supposed to repair a disabled electronics device or system in the field. That person will likely not know ahead of time which component value he will need to replace. Thus, he may need to take a fairly complete collection of component values on the road with him during his field service missions. This transportation of different components might be necessary or desirable for others who may have to move from one laboratory to another, or do repairs in the field, or at a customer's plant, or the like. But the bulkiness of many individual storage containers to transport and arrange for effective quick access would present considerable problems to such a person.

Many of the above-described packaging and storage techniques share common problems. For example, typical surface mount resistors are very small. They may be stored in a very small space, perhaps two to four milliliters in size, for approximately 500 identical components. This means that the size of the bottle, tape reel, or storage cassette is typically many times larger than the actual size of the surface components. This is one of the reasons why storing 100 or more containers, each having hundreds of an identical value of a particular component, ends up taking a fair amount of space, and represents an unwelcome chore.

When needing a component of a particular value, the user has to locate the right bottle, tape reel, or storage cassette first. This is not always easy as there are typically over one hundred of them crowded in one place. The situation is worsened as the user needs to put a component back since one of his hands may now be occupied holding that component. Furthermore, in the case of the tape reel, putting the component back is not possible. Throwing away components wastes money as some of these components cost over ten cents per unit.

In like manner, other tiny electronic components such as surface mount capacitors and surface mount inductors, which also come in dozens of different values, need to be stored in a convenient manner. All of the foregoing problems of storage discussed with respect to surface mount resistors generally also applies to surface mount capacitors. Thus, for an electronic technician or engineer to carry about a full complement of all values of these passive electronic components would require that person to walk around with well more than one hundred storage containers. This is quite cumbersome and/or impractical in the field, or in an environment like a large company or a university, where research and circuit board repair may be or is carried on in a few different locations or sites, between which the various containers full of components need be shuttled.

There are still other problems with these known storage methods. The small individual containers can be easily knocked over. Also, sometimes a soldering iron or other heat source may accidentally be placed in close proximity to an individual container or plastic bag and might cause damage through melting. Further, the thin plastic films bags can be punctured quite easily, with a possible spilling and loss of components through the hole or tear in the bag. Another problem is that the labeling of the component values may not be provided in a convenient easy-to-read style by the manufacturer on its packaging. Even when easy-to-read labels are provided, there is still the problem of arranging the individual storage containers or bags with their labels all oriented the same way to make them easy to read at a glance, when they are stored on a shelf or in large bins or drawers.

There is one kind of plastic box which has a plurality of cells, such as eight, ten or twelve to perhaps about fifteen or twenty-four, with a single lid that covers all of the cells at once. These familiar rigid all-plastic containers may be opaque or translucent, or they may be substantially transparent, so that objects stored within the individual cells can be viewed easily. Such plastic boxes are often found for sale in hardware stores as empty containers and are sold so the user can use them to store whatever he wants. In other cases, the containers are sold with a complement of different size objects of the same kind therein, such as a collection of flat washers, or a collection of hex nuts, or a collection of machine screws or the like. But these single-lid boxes generally do not have enough number of cells for storing well over 100 different values of surface mount electronic components. Also, since the lid is not tight enough, often the box allows for the contents of the individual cells to be easily mixed if the box is accidentally jostled or bumped severely even when the lid is closed.

Still one more approach for storing multiple small objects of the same basic type is to provide a plastic box having a plurality of cells, such as four or six or seven or eight or up to 28 or 32, with individual plastic covers for each cell. In this arrangement, the individual cells can be opened one at a time, without disturbing the covers or the contents of the other cells. As before, these familiar rigid all-plastic containers may be opaque, translucent, or substantially transparent. These storage containers are often sold in drugstores as empty containers so the user can store his or her own medicine in the form of pills or tablets that are to be taken during the day or the week or the month. One such plastic pill box, called a "daily box," has eight individual cells in a 2-by-4 cell arrangement for taking medicine at regular intervals eight times a day. Another such box, called a "weekly box," has seven cells in a single row, each with individual cover. The weekly box is designed to make it easy to store and take one cell's worth of medicine, once a day, for an entire week. Another box, called the "monthly box," has 28 cells, each with a separate cover.

In all three types of boxes (daily, weekly, monthly), the covers are typically connected to the adjacent side or back of the cell by a living hinge or other flexible plastic portion. The covers typically snap into place in some way. A mechanical latch made of the same plastic may be used, or an interference fit between complementary mating members of the lid and one or more side wall surfaces of the cell may be used.

Limited by the number of cells, these small multiple-cell pill boxes are clearly inadequate for conveniently storing large numbers of surface mount components having different values, such as over 100 different values of components. The multi-cell boxes with individual covers on the cells largely overcomes the problem of accidentally mixing components in a single-lid box when the lid is open. But there is the chance than an individual lid will not be fastened securely over its cell. If an individual lid is not shut tight or left open accidentally, there is the chance that the contents of that cell will be spilled. Also, these multiple-cell boxes generally do not have a particularly convenient surface on the lid upon which to securely place an easily read label.

Accordingly, a system of organizing and storing small items such as miniature electrical components remains wanting.

In light of the foregoing needs, one object of the present invention is to provide a new container system which overcomes these problems in a way that enhances the convenient access for the user, and is cost-effective too.

A related object of the present invention is to provide a container having multiple individual cells with each cell having its own cover, while having a master cover.

A further related object of the present invention is to provide such a container having a main lid which covers and protects the compartment housing the individual cells and their covers.

A related object of the present invention is to provide the covers of the individual cells with a tab that can be readily opened and closed by the operator.

Yet another object of the present invention is to provide areas on the tabs which allow for the attachment of easily read labels.

Still a further object of the present invention is to provide a container and a main lid which are formed so as to stack, top-to-bottom, with other containers.

Yet another object of the present invention is to provide such a container which is formed from a resilient yet light weight material such as a plastic, so that the cost is low and the serviceable lifetime is long.

These and other objects, features and advantages of the present invention will become clear upon reading the following summary and detailed description of the parts container of the present invention.

SUMMARY OF THE INVENTION

In light of the foregoing objects and to help solve the above-identified problems, there is provided, according to a first aspect of the present invention, a compact three-dimensional storage container having a plurality of individual storage compartments all located under a single large lid. Each of the individual storage compartments is provided with its own individual lid so that it may be separately accessed while the other individual storage cells may be kept closed.

According to a further aspect of the present invention, the overall size of the storage container preferably resembles the size of a typical medium-sized college textbook placed upon a book shelf. Thus, several such storage containers can easily be put onto the shelf of the technician, perhaps alongside of textbooks and reference books, and easily accessed by pulling the container out much the way a person would pull out a book.

The container is provided with a main lid which may be permanently connected by a flexible hinge arrangement to the base portion of the box. Preferably, however, the lid portion is removable from the bottom portion of the box which contains the individual storage cells. The reason for this is that space is typically at a premium on the laboratory work bench where the components are actually being used by the technician or engineer. Having the main lid removed and placed somewhere else, e.g. underneath the base portion of the box, instead of laying it on the work bench, will help save valuable space. Thus, the main lid can be removed and reattached many times as is necessary for the convenience of the technician. Each individual cell within the box is provided with its own cover, preferably permanently connected by a flexible hinge arrangement to the back or side wall of the cell.

One benefit of having individual covers upon the cells of the storage container is that, given the possibility of splatter of solder or other chemicals, materials or debris during repair, the plurality of covers minimizes the likelihood of damage to the contents of any given cell. By having individually closed cells, this minimizes the chance for accidental contamination, or static discharge which, in the case of an electronic component could fry or otherwise damage its delicate semiconductor junctions.

The present invention also overcomes the problem encountered when using surface mount components with respect to the printed value of the component provided on the component itself. These identifications are typically so small (due to the size of the component itself), that the user has difficulty in reading them. Thus, according to an additional aspect of the present invention, the present invention provides much larger written labels on the top of each individual cell cover so that the user can easily see the value of the component that is supposed to be found underneath that cover within the cell.

An additional aspect of the invention provides that the container be advantageously and preferably composed of a polymerized material. In the case of passive electronic components such as resistors and capacitors, the typical static discharge generated by handling the components does not normally present any problems. But, in the event of the storage of active electronic components within the container, it is practical to provide a conductive plastic out of which to make the container.

Another advantage of the design of the present invention is that the individual cells within the container are separated by an outer skirt from the outside of the overall container or box. This provides insurance against possible heat damage to the integrity of the side walls of the individual cells. Thus, in the event of a hot soldering iron for example, at most the outside of the wall of the box might be partially melted, and the interior wall would not be affected, and the box could still be used.

In accordance with still another aspect of the present invention, the main lid for the overall enclosure is in very close proximity to and/or bears down and presses at least lightly upon the uppermost portion of the raised pull portion of the cell cover. In this manner, the closing of the main lid will also help ensure that the individual covers to the cells found thereunder are also closed. Since the main lid itself will be a relatively large area equal to the height and width of the box (i.e., the largest outer surface), the user will be able to push with his hands or fingers upon the outside face of the main lid, and effectively snap shut any individual cell cover which might not be completely closed or at least keep them closed tightly on their respective cells. Accordingly, because the flat expense of the main lid can be depressed downward toward the center of the box, the user will be able to do this in order to help ensure all the individual covers to the cells are snapped shut. This is a quick and efficient method for ensuring all of the covers of the cells are shut properly. Accordingly, by closing the main lid, instead of checking the closeness of each cell cover, all the individual cell covers will be kept closed so that the components inside will not be spilled out and lost due to shaking or being knocked over.

Another advantageous aspect of the present invention is that each cell cover has a raised finger-grip pull portion for opening and closing. This makes it possible that all the cells are connected together and share the same walls between the adjacent cells. Thus, there is no need to leave space between the adjacent cells and much space is saved. The raised finger-grip pull portion is connected to the top portion of the cell cover. This finger-grip portion can be easily reached so as to allow the user by a single finger-tip to open an individual cell cover. The recessed area may be provided on the flat part of the cover for placing in an adhesive-backed label containing the component value and/or other specifications for the user to see. While the living hinge provided on the individual cells is relatively thin, it can be appreciated due to the larger size of the cover to the overall container, that much larger and more rugged hinge and fastener arrangements may be provided for the main lid.

In addition, since the finger-grip pull portions are all of the same height when snapped into place, any force placed on the main lid will naturally be substantially evenly distributed over the several nearest pulls under and adjacent to the area of the downward force, thus avoiding an overload condition on any one pull. Thus any partially-open cell covers will be snapped shut, and thereafter the box will have the strength to withstand a significant downward force, such as a stack of heavy books placed on the top of the container. In addition, the sturdy main lid effectively protects the much smaller and weaker cell covers from destruction or damage during storage or transport. Thus, those in the art will appreciate that the multiple-cell, dual-lidded plastic storage container of the present invention is both rugged for its size and will last in service for a significant length of time.

Several other important aspects of the present invention exist, including the methods for using the above-described equipment of the present invention. The aforementioned aspects, objects and advantages of the present invention will be better understood by examining the preferred embodiments of the present invention illustrated in the figures and by studying the detailed descriptions and claims found below.

BRIEF DESCRIPTION OF THE DRAWINGS

In the drawings, where the same reference numerals indicate similar components or features in the various figures.

DETAILED DESCRIPTION OF THE PREFERRED EMBODIMENTS

The drawings disclose the preferred embodiment of the present invention. While the configurations according to the illustrated embodiment are preferred, it is envisioned that alternate configurations of the present invention may be adopted without deviating from the invention as portrayed. The preferred embodiment is discussed hereafter.

Figure 1:
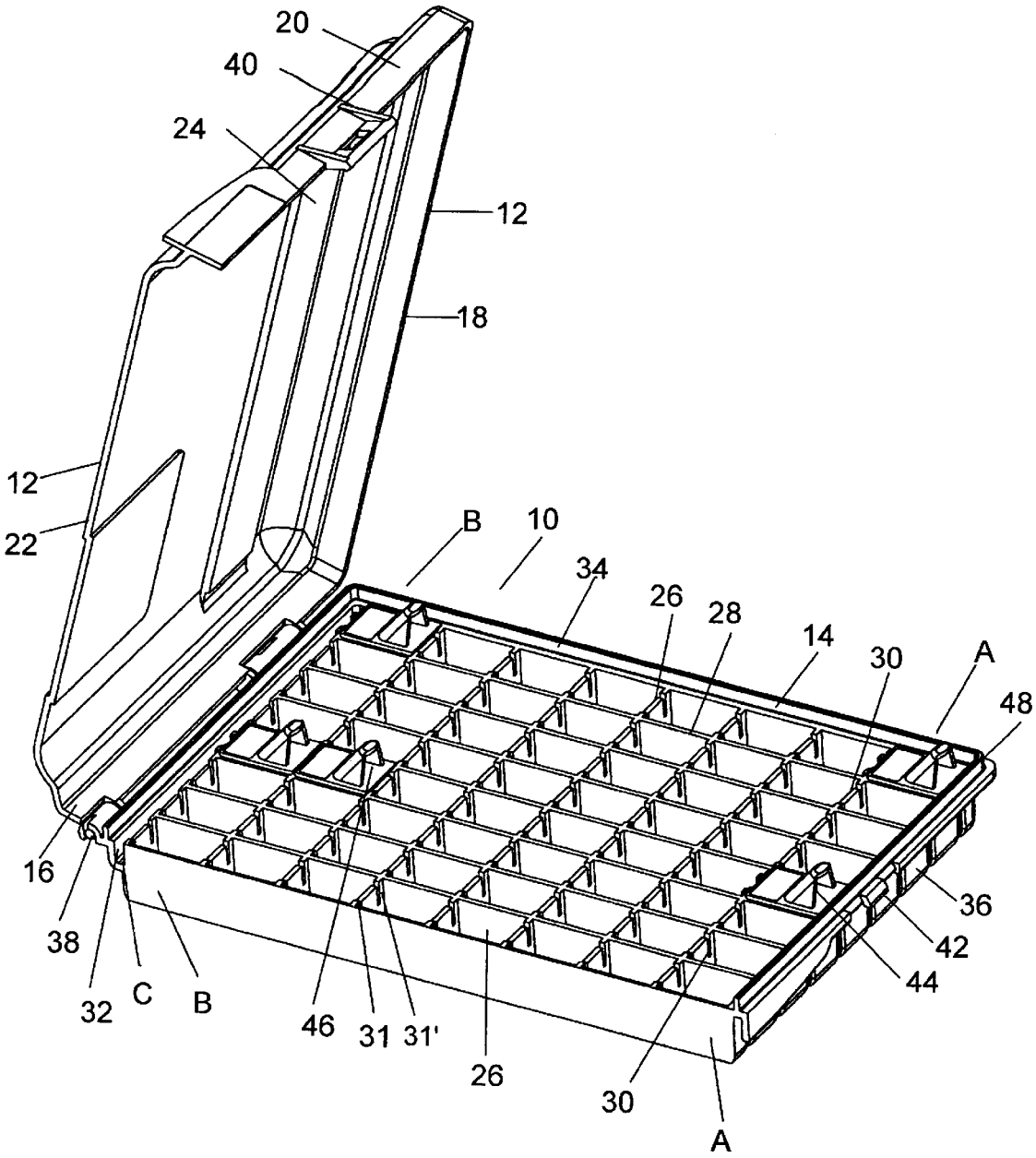
FIG. 1 is a perspective view of a portable closable container with individually closable cells according to the present invention shown partially broken away and with its lid in its open position.

FIG. 1 is a perspective view of a portable closable container, generally illustrated as 10, according to the present invention. The closable container 10 includes a lid 12 and a base 14. The lid 12 is illustrated in its preferred shape and includes a back wall 16, a first side wall 18 (an opposing or second lid side wall being present although not being illustrated in this view), a front wall 20, and a top wall 22. The top 22 preferably includes a recessed area 24 formed therein to allow stacking of the container 10 with other like containers as will be described and discussed below with respect to FIG. 4.

The base 14 includes a plurality of individual cells 26. The cells 26 are defined by a plurality of spaced apart, substantially parallel vertical walls 28 and a plurality of spaced apart, substantially parallel horizontal walls 30 which intersect the vertical walls 28. As illustrated, the shape of the cells 26 is substantially rectangular, and it is to be understood that the cell shape is not to be limited to such configuration and may be square or virtually any other shape.

The vertical walls 28 and the horizontal walls 30 define the individual cells 26. Each cell 26 is defined by a portion of the walls 28 and 30. As illustrated, a pair of slots 31, 31' are defined in the upper ends of each portion of the horizontal wall 30 defining the end walls of the cell 26. The slots 31, 31' have a component anchoring function as will be discussed below with respect to FIGS. 6 through 9.

The base 14 also includes a back wall 32, a first side wall 34 (an opposing or second base side wall being present although not being illustrated in this view), a front wall 36, and a bottom wall (also not shown in this view).

A hinge assembly 38 is provided between the back wall 16 of the lid 12 and the back wall 32 of the base 14. The hinge assembly 38 connects together the lid 12 and the base 14. As illustrated, the hinge assembly 38 is of the rotatable pin-in-sleeve type, although it is to be understood that other sleeve arrangements (such as lining hinges) may be used.

The secure closure of the lid 12 with respect to the base 14 is preferably accomplished by way of a snap-type closure comprising a female snap portion 40 provided on the front wall 20 of the lid 12 and a male snap portion 42 provided on the front wall 36 of the base 14. It is to be understood that other types of closure mechanisms may be used and the invention is not to be limited by the illustrated closure configurations.

Each of the cells 26 may be provided with an individual cell cover 44. The covers 44 may be opened or closed independently. Each of the covers 44 include a finger-operable tab 46 formed thereon. The cell covers 44 are illustrated in detail in FIGS. 6 through 11 and is discussed below in association therewith.

The storage container 10 may have 100 or more, and preferably 128, individual cells 26, all located under the lid 12. Each of the individual storage cells 26 will have its own individual cover 44 so that it may be separately accessed while the other individual storage cells 26 may be kept closed. The overall size of the storage container 10 when viewed standing on its narrowest side is preferably on the order of between 6 inches to 18 inches wide, and between 8 inches to 14 inches high, and between about ½" to 2 inches thick. Preferably, the overall size is between about 7 inches to about 12 inches wide and between about 9 inches to about 13" high, and between about 0.7 inch and about 1.5 inches thick. Most preferably, the container will be between about 8 inches and about 9 inches, and between about 11 inches and about 12 inches high, and about 0.8 inch and about 1.25 thick, with a thickness between 0.9 inch and about 1.1 inch being presently preferred as best. In other words, the storage container 10 will preferably resemble the size of a typical medium-sized college textbook placed upon a shelf. Thus, several such storage containers 10 can easily be put onto the shelf of the technician, perhaps alongside of textbooks and reference books, and easily accessed by pulling the container out much the way a person would pull out a book.

The various components of the container 10 are preferably comprised of a polymerized material such as a plastic. Composition requirements may be dictated by the contents themselves. For example, in the case of passive electronic components such as resistors and capacitors, the typical static discharge generated by handling the components does not normally present a problem. However, in the event of the storage of active electronic components within the container, it is preferably to provide a conductive plastic out of which to make the container. Possible plastic materials include polypropylene, K-resin, and similar polymers. Of course, while plastic is the preferred material, many or all of the plastic materials may be substituted for with other materials including, for example, metals, glass, etc.

FIG. 1 also illustrates a continuous ridge or lip 48 formed along the top sides of the back wall 32, the side wall 34 (as well as the opposing but not shown other side wall), and the front wall 36 of the base 14. The ridge 48 is configured so as to fit just within the back wall 16, the side wall 18 (as well as the opposing but not shown other side wall), and the front wall 20. The ridge 48 has utility in not only improving structural integrity but also serves a sealing function to keep dust, dirt, and other undesirable material from the inside of the container 10 when the lid 12 is closed.

Figure 2:
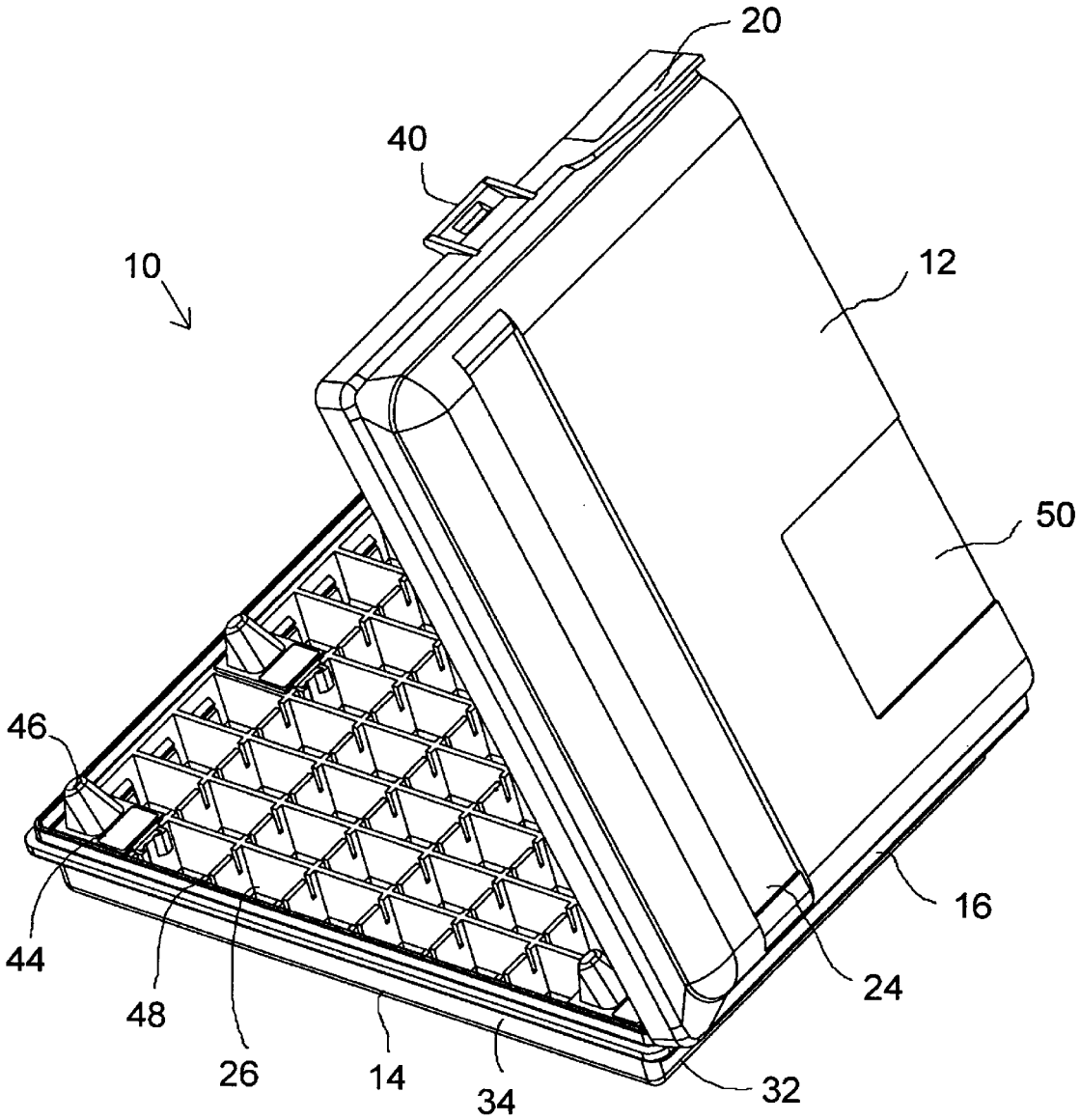
FIG. 2 is a perspective, partially broken away view of the container of the present invention similar to that shown in FIG. 1 but illustrated generally from a back side angle.

FIG. 2 is a perspective view of the container 10 similar to that shown in FIG. 1, but showing the container 10 from the back side. Among other advantages, the view of FIG. 2 illustrates more clearly the recessed area 24 provided for stacking. An additional recessed area 50 may be provided for labelling.

Figure 3:
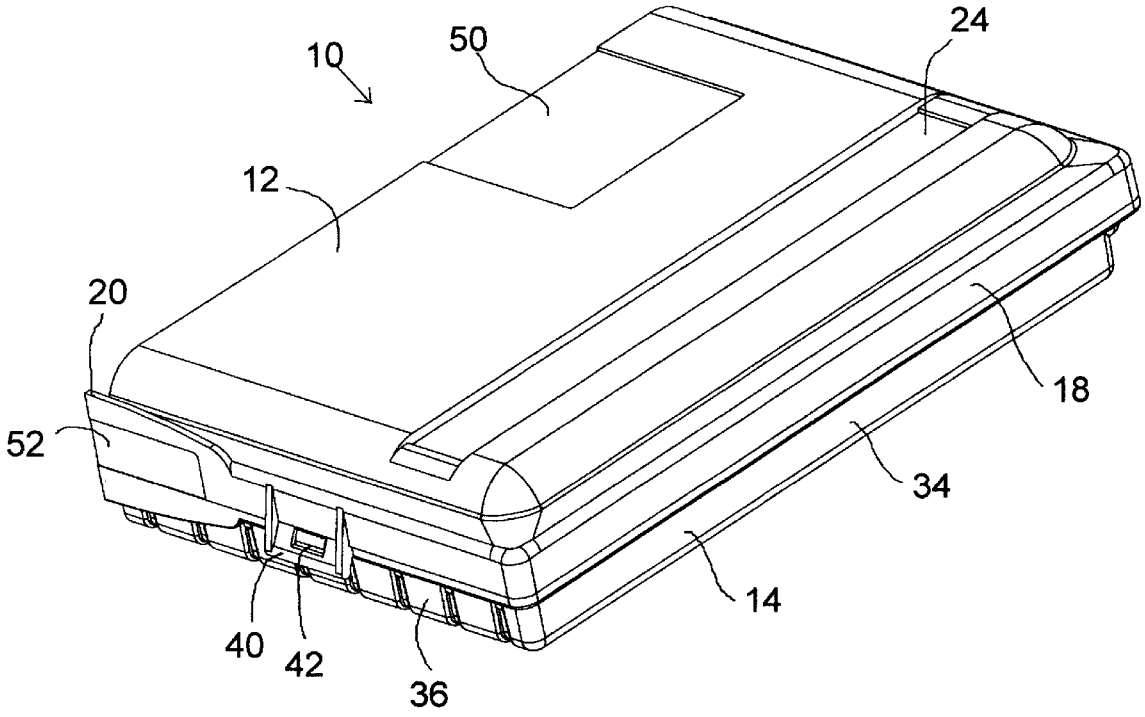
FIG. 3 is a perspective, partially broken away view of the container of the present invention shown with its lid in its closed position.

FIG. 3 is a perspective view of the container 10 illustrating the lid 12 in its closed position with respect to the base 14. Like FIG. 2, this view more clearly illustrates the recessed area 24 and the recessed area 50.

FIG. 3 also illustrates the overlap of the lid 12 with respect to the base 14. This overlap is a result of inclusion of the ridge 48. The overlap is useful in providing a method by which the container 10 may be securely grasped and lifted from a flat surface such as a table or repair bench.

FIG. 3 additionally shows a recessed region 52 formed on the front wall 20 of the lid 12 which may optionally accommodate a label.

Figure 4:
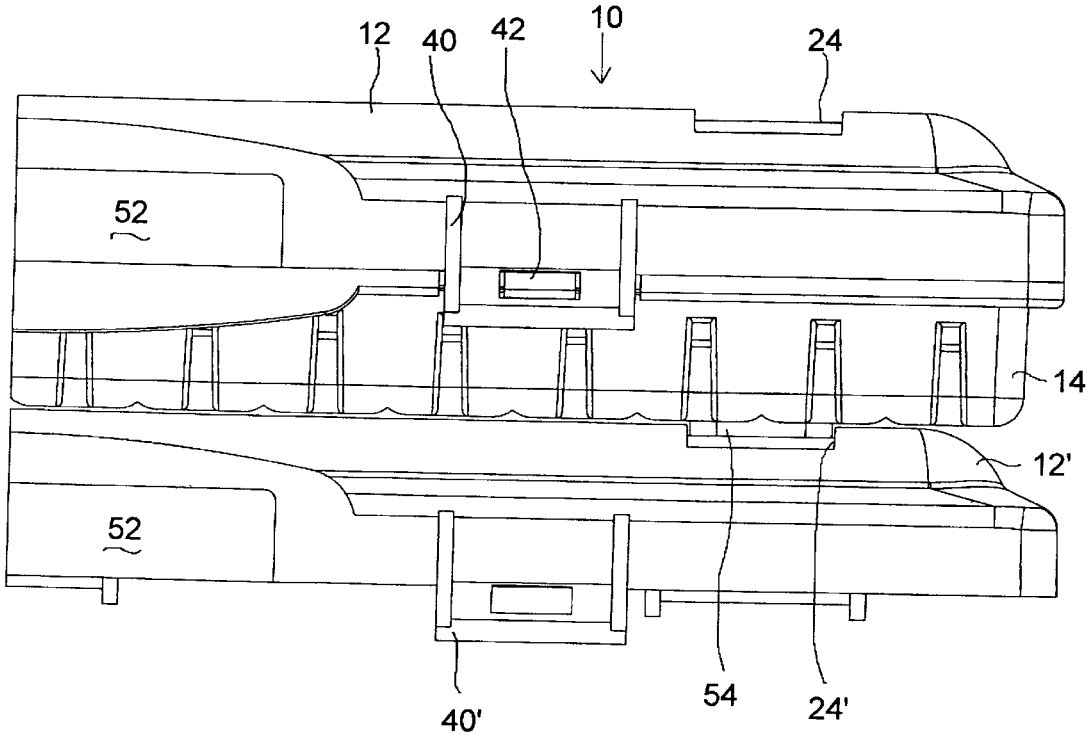
FIG. 4 is an elevated front view of a portion of a container according to the present invention, lid closed, stacked upon a portion of another container's lid.
Figure 5:
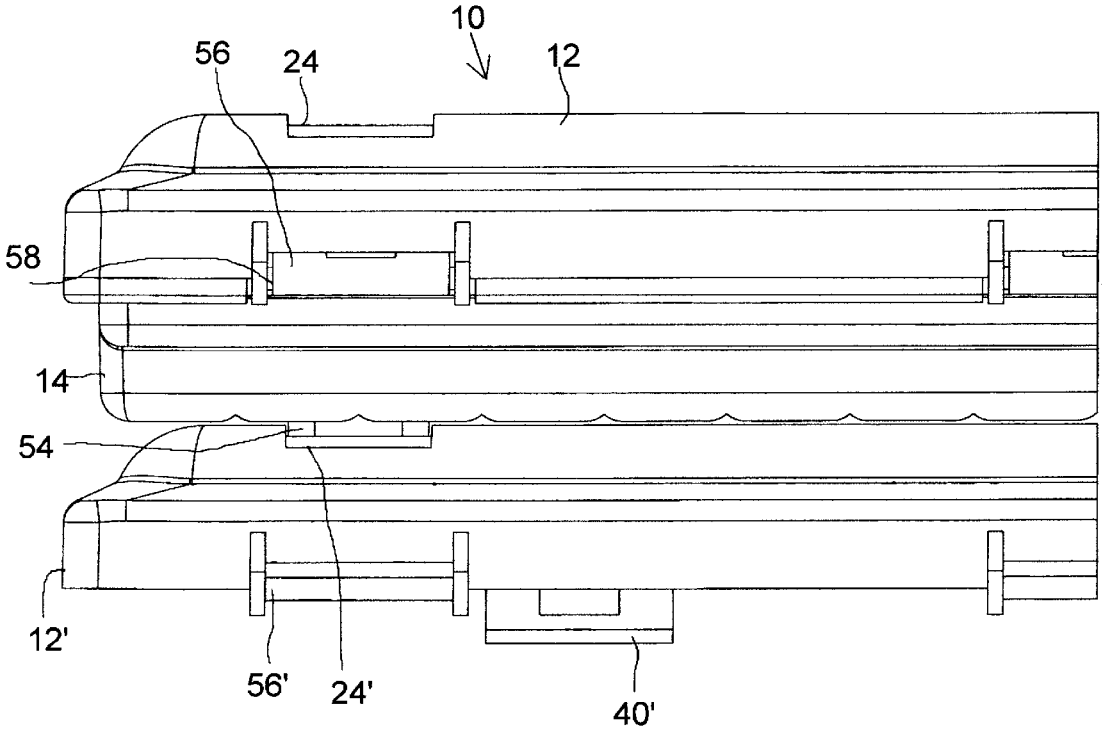
FIG. 5 is an illustration of the present invention similar to that of FIG. 4 but viewed from the back.

FIGS. 4 and 5 illustrate a front elevational view and a rear elevational view respectively of the container 10 shown in position with respect to a lid 12' of another container (shown, for illustration purposes only, without the base 14). This view more clearly demonstrates the stackable feature of the present invention. A foot 54 is formed on the bottom wall of the base 14 of the container 10. The foot 54 extends substantially along the bottom wall in a continuous manner between the back wall 32 (not shown in this figure) and the front wall 36. The width of the foot is configured so as to roughly correspond with the width of the recess 24. Accordingly, and as illustrated in FIGS. 4 and 5, stacking is accomplished by positioning the foot 54 in a slot 24' of an underlying lid 12'. The foot 54 may be fitted with grips composed of a rubber or a similar material to prevent sliding along a smooth surface. Such construction would also resist shifting while one container is stacked on top of another container. Another more preferable way of providing this shift-resisting function is to build two wedges on each end of the slot, so that the foot 54 will not slide out of the slot 24'.

FIG. 5 illustrates in addition the preferred construction of the hinge assembly 38. Preferably, the hinge includes a sleeve 56 (which is formed in this case on the lid 12) and a pin or dowel 58 (which is formed in this case on the base 14). The sleeve 56 is preferably open to one side such that the lid 12 may be selectively snapped on and off the base 14 as desired. This feature allows the user to remove the lid 12 entirely at such times as more bench space is required. Of course, and as noted above, the hinge assembly 38 may instead be a lining hinge which has the comparative advantage of being inexpensive to manufacture but has the comparative disadvantage of being non-removable.

Figure 6:
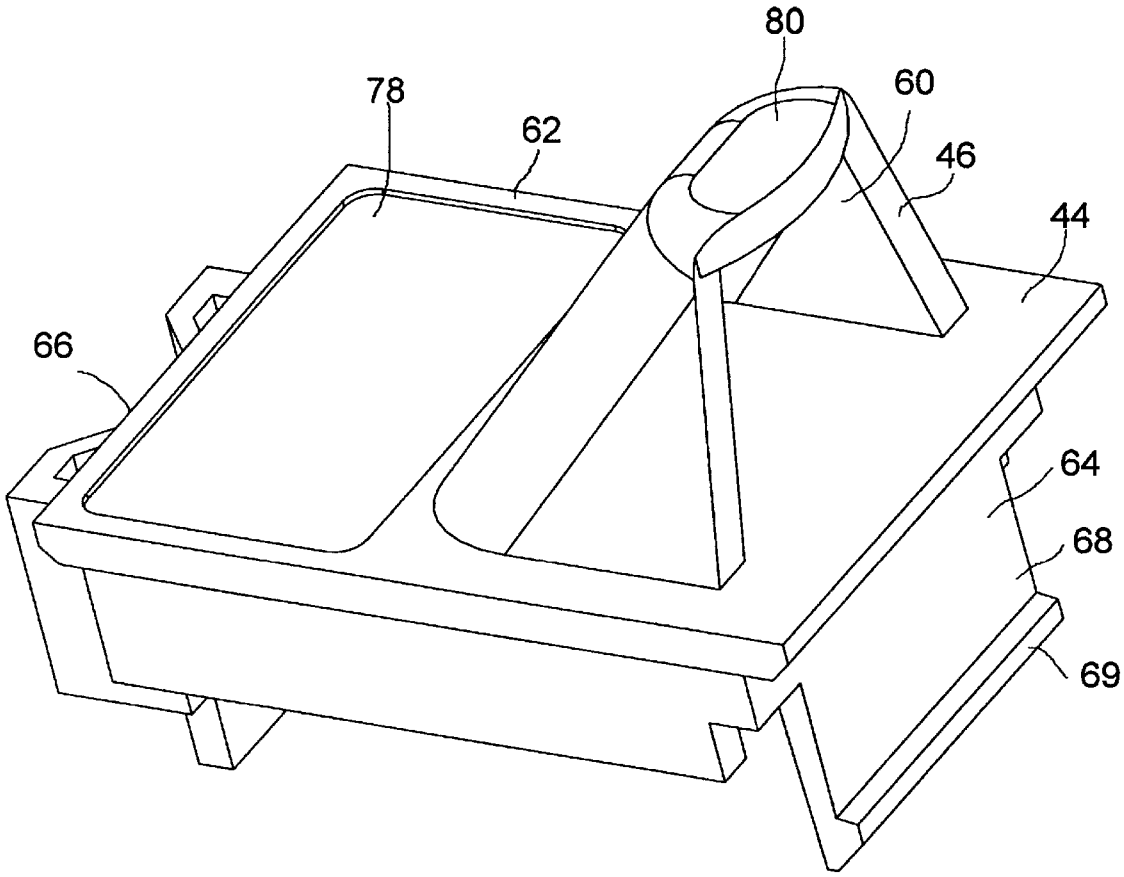
FIG. 6 is a perspective view of an individual cell cover, viewed generally from the front side of the lifting tab of the cell cover, for use in conjunction with the container of the present invention shown in the preceding figures.

FIGS. 6 through 9 disclose various views of the cell cover 44. As noted above, the cover 44 includes a finger-operable tab 46. FIG. 6 illustrates a cavity 60 formed on the underside of the tab 46. The cavity 60 permits the operator to insert a fingertip to manipulate the cover 44 for removal from the cell 26. The cavity 60 also saves cover material without reducing much of the cover's rigidity.

Figure 7:
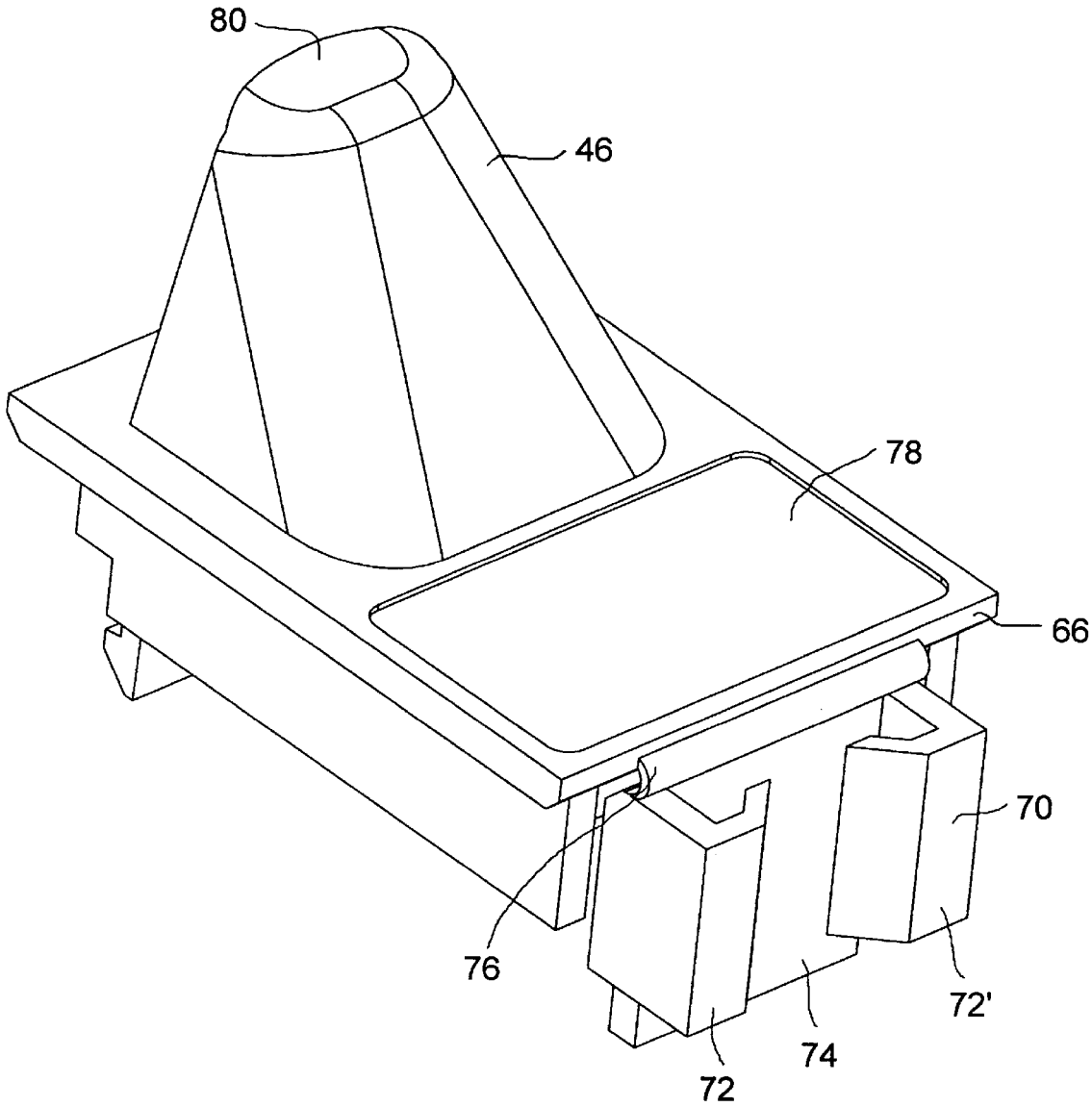
FIG. 7 is a perspective view of the individual cell cover shown in FIG. 6 viewed generally from the back side of the lifting tab.
Figure 8:
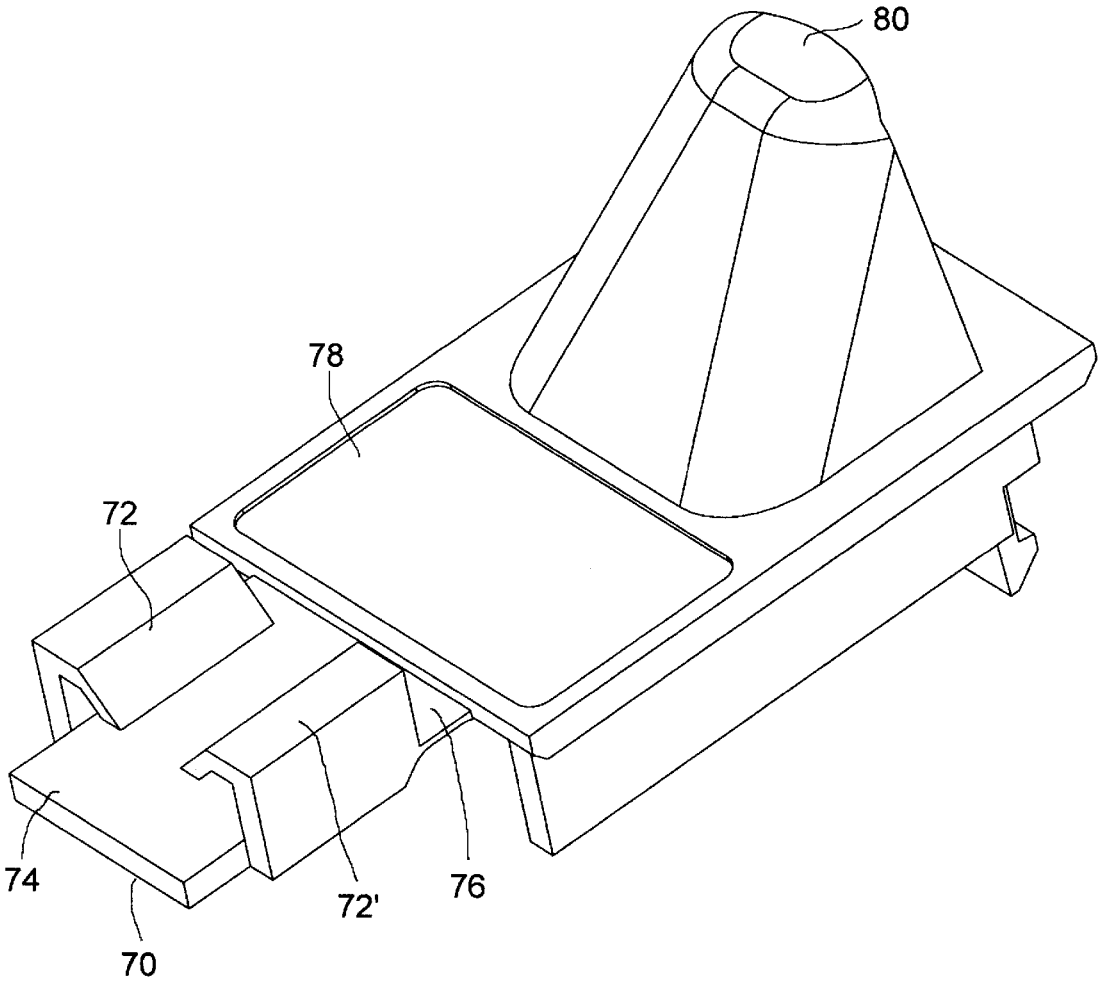
FIG. 8 is a perspective view of the individual cell cover of the present invention similar to the view of FIG. 7 but illustrating the integrated cell cover-to-container divider coupler in its extended or open position.
Figure 9:
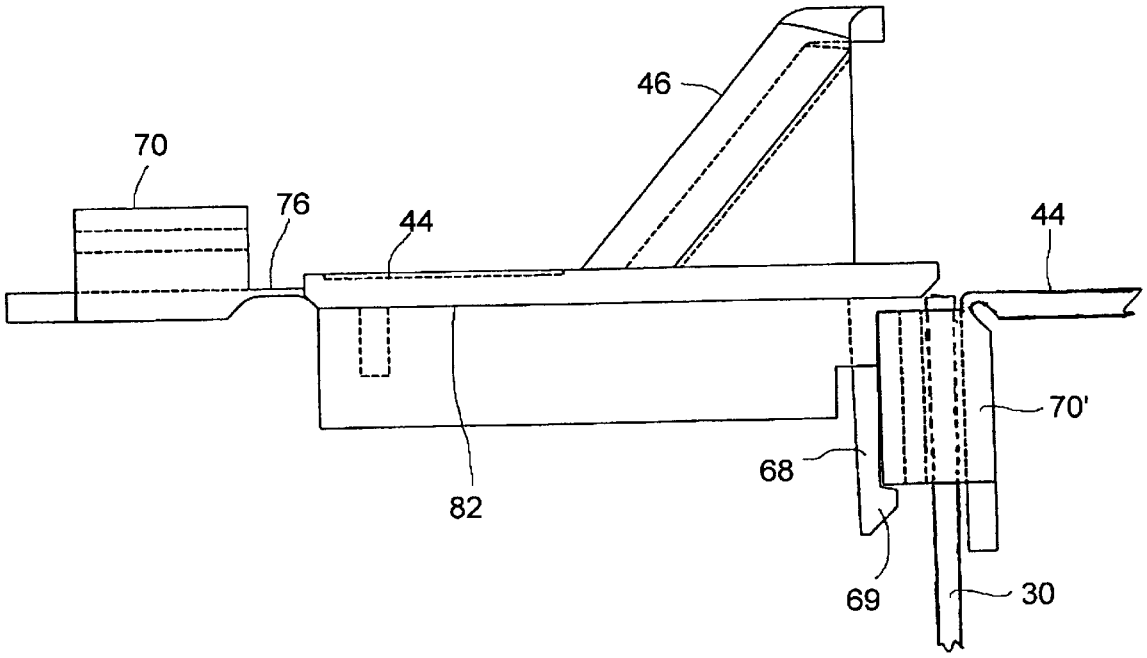
FIG. 9 is a side view of the cell cover of the present invention shown in partial cross-section with its integrated coupler in its extended or open position.

In addition to the tab 46, the cover 44 includes a body 62 having a front end 64 and a back end 66. The front end 64 includes a locking tab 68. Along the base of the locking tab 68 is provided an engaging lip 69. The back end 66 of the cover 44 includes a combination hinge-fastener 70 which is pivotably attached to the body 62. As best shown in FIGS. 7 and 8, the hinge-fastener 70 includes a pair of opposed and spaced apart engaging tabs 72, 72' which extend from a backing plate 74. A relatively thin portion of material 76 bridges the backing plate 74 of the hinge-fastener 70 to the end 66 of the cover 44. FIG. 7 illustrates the bridge material 76 in its flexed or "closed" position. FIGS. 8 and 9 illustrate the bridge material 76 in its unflexed or "open" position. The thickness of the material 76 is determined by wear requirements. Ideally, the material 76 should be just thick enough so as to provide a hinge which will endure many flexings and just thin enough so as to avoid impeding the flexing action.

The engaging tabs 72, 72' provide two functions. First, they cooperate with the slots 31, 31' (discussed above with respect to FIG. 1) to anchor the cover 44 to a respective one of the cells 26. The tabs 72, 72' are friction fitted in the slots 31, 31'. The cover 44-cell 26 relationship illustrated in FIG. 2 effectively illustrates this anchoring relationship. FIG. 9 also illustrates a portion of a cover 44' fitted to a portion of a horizontal wall 30.

Second, the engaging tabs 72, 72' operate to retain an adjacent cover 44 in its closed position. With specific reference to FIG. 9, the engaging lip 69 of the tab 68 releasably engages the lowermost end of the tabs 72, 72' when the cover 44 is in its closed position. The tab 68 is somewhat flexible, so release of the cover 44 from its closed position is readily accomplished by relatively gentle upward force applied to the finger-operable tab 46.

One of the difficulties frequently encountered by technicians is to read the small numbers and letters of SMR's and like components. To overcome this problem, the present invention provides for large label surfaces on each of the covers 44. Specifically, and with reference to FIGS. 6 through 8, a recessed label surface 78 is defined on the top side of the body 62 of each cover 44. The surface 78 provides an area where the identifying number of the component may be written in or where a paper identifying tab may be attached. Of course, other surfaces may be used for marking. For example, an upper surface 80 of the finger-operable tab 46 may be optionally or additionally used for placement of component indicia. The upper surface 80 of the finger-operable tab 46 also functions as a contact region against which the cell cover-closing structure of the lid 12 (shown in FIG. 12 and discussed below with reference to that figure) presses when lid 12 is moved to its closed position. As a further option, the technician may elect to mark the underside of the body 62 of each cover 44 at a region generally identified as 82 in FIG. 9. This would allow the technician to identify the enclosed component when the cover 44 is in its closed position as well as when it is in its open position.

Figure 10:
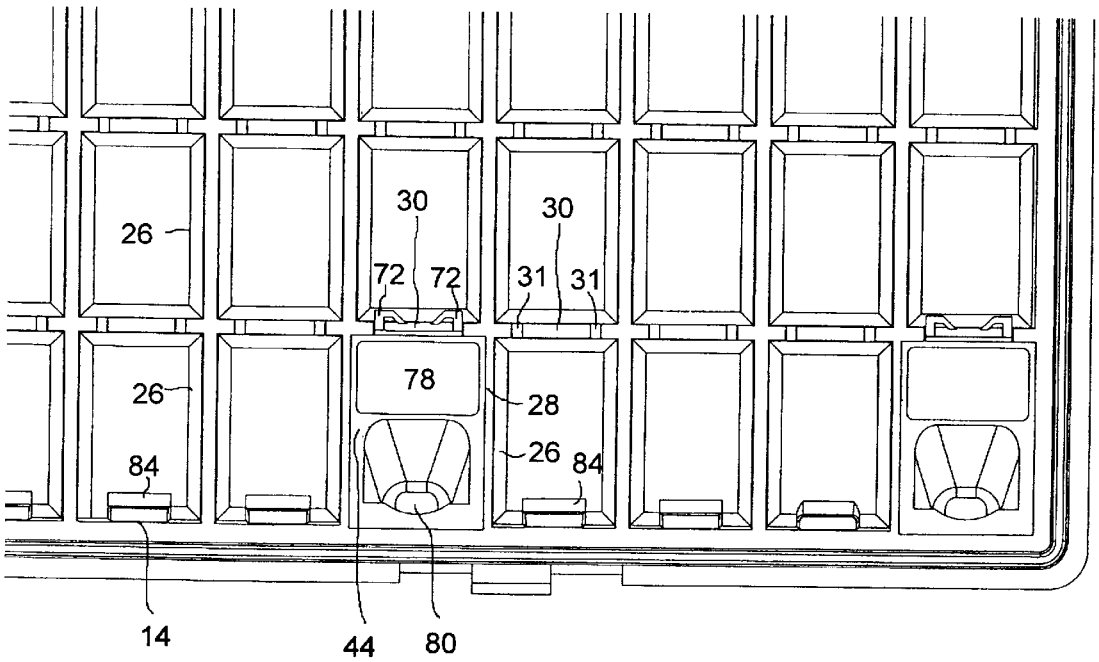
FIG. 10 is a top view of the cell cover in its closed position over one of a plurality of adjacent cells of the container of the present invention.

FIG. 10 illustrates a top view of the cell cover 44 in place in the base 14 of the container 10. The illustrated view is a close-up, detailed view of a single cell cover 44 in place among a number of adjacent uncovered cells 26. This view illustrates how the cell cover 44 fully and effectively encloses the open top of the underlying cell 26. FIG. 10 is also useful in illustrating how the cover 44 is secured to the horizontal wall 30 by means of the engaging tabs 72, 72' being secured within the slots 31, 31'.

As discussed primarily in relation to FIG. 9, the engaging lip 69 engages the lowermost end of an adjacent cover's hinge-fastener 70. However, the front most row of cells 36 (illustrated as "A" in FIG. 1) would not have the benefit of an adjacent cover 44 to provide a hinge-fastener. Accordingly, the inner side of the front wall 36 of the container 10 is fitted with a series of ridges 84 which extend therefrom to be engaged by respective engaging lips 69 when the covers 44 are in place. (One of the ridges 84 is visible in FIG. 12, discussed below. In addition, it should be noted that a channel C [illustrated in FIG. 1] is formed between the back wall 32 of the base 14 and the rearward-most row of cells 26 [illustrated as "B" in FIG. 1] to accommodate a portion of the thickness of the engaging tabs 72, 72' of each of the covers 44.)

Figure 11:
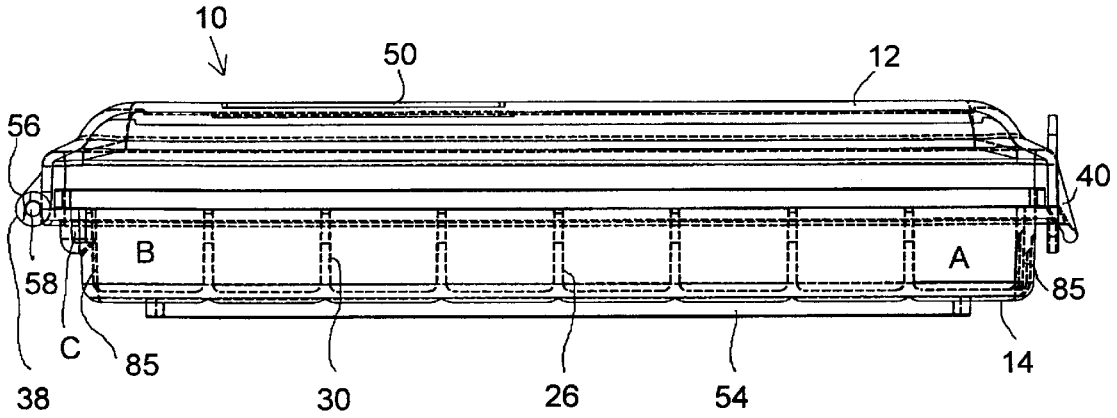
FIG. 11 is a cross-sectional view of the container of the present invention with its cover in its closed position taken from one side so as to illustrate both the hinge end and the snap end.
Figure 12:
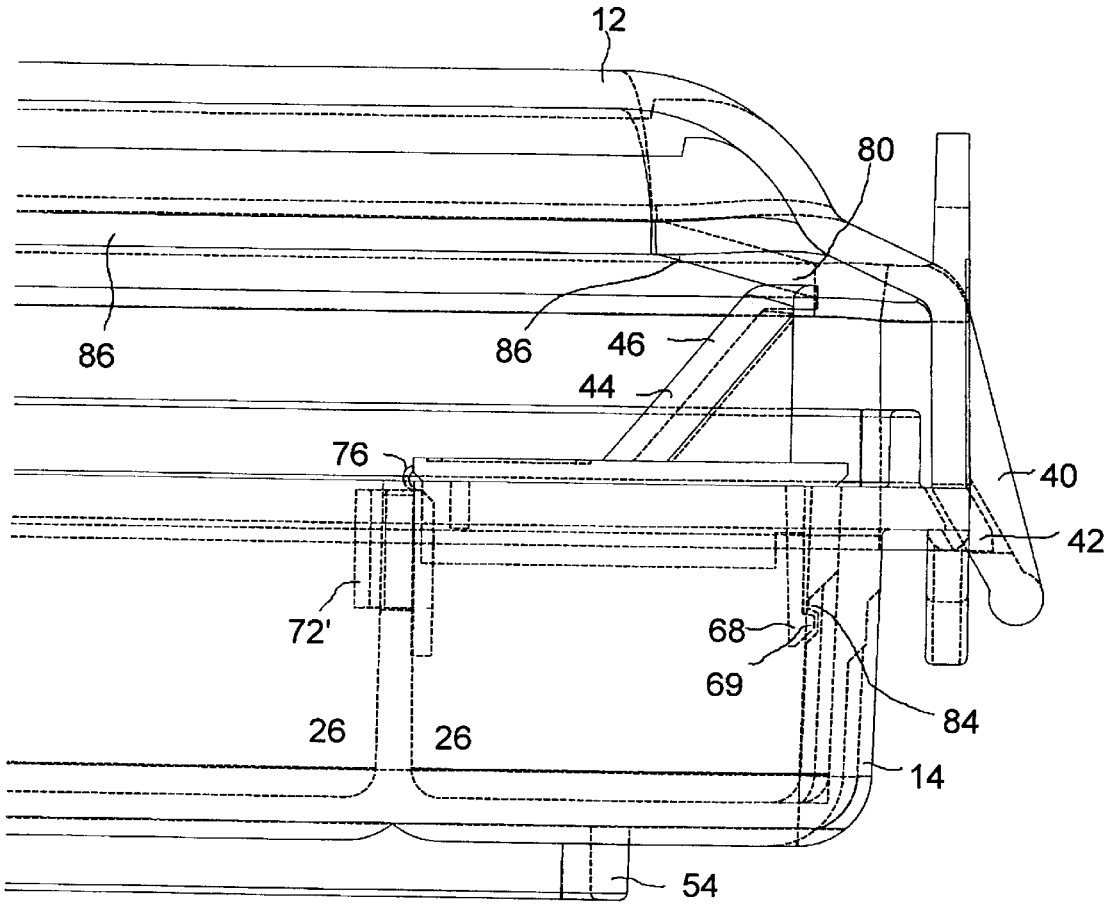
FIG. 12 is a broken away and cross-sectional view of the snap end of the container of the present invention shown with the cell cover in place and in its closed position.
Figure 13:
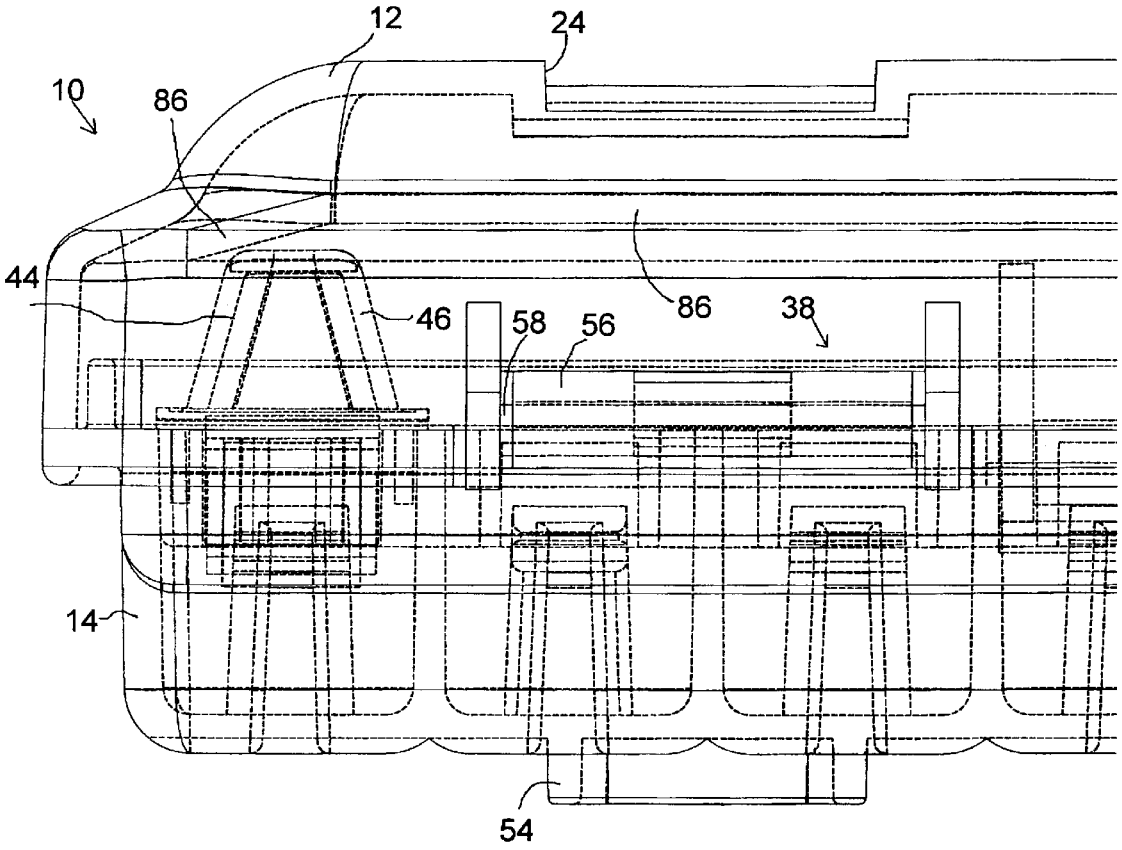
FIG. 13 is a broken away and cross-sectional view of the hinge portion of the container shown with the cell cover in place and in its closed position.

FIGS. 11 through 13 are various cross-sectional views of the container 10 illustrated with the lid 12 moved to its closed position with respect to the base 14. Referring to FIG. 11, a plurality of individual, side-by-side cells 26 are seen. In addition, FIG. 11 demonstrates one of the several noteworthy features of the present invention related to cell insulation. A gap 85 is preferably formed between the outermost of the array of individual cells 26 and the end wall 32, side wall 34 (and its opposing unnumbered wall), and front wall 36 of the base 14. The gap 85 provides insurance against possible heat damage to the integrity of the side walls of the individual cells 26. Thus and for example, in the event of a hot soldering iron contacting the outer walls of the base 14, the interior walls which define the outermost set of cells 26 will not be affected.

With specific reference to FIG. 12, a close-up sectional view of the fastener end of the container 10 is illustrated. The cover 44 is shown in place in one of the cells 26. This illustration is also useful in showing the ridge 84 and its operative relationship to the engaging lip 69 of the locking tab 68.

One of the several features of the present invention is the mechanism employed for securing closure of the covers 44 on their respective cells 26. The user will frequently find himself transporting the container 10 with all of the components enclosed in their various cells. The book-like shape of the container 10 encourages the user to carry the container like a book and, as such, there is a the risk of one of the covers 44 failing to retain the parts within the given cell 26 (due perhaps to improper closing by the operator). With the contents of two or more cells commingling, chaos could result.

To avoid this unsavory end, the container 10 is preferably fitted with a retaining system whereby slight pressure is applied to the upper surfaces (approximately the label surface 80) of the finger-operable tab 46. The slight pressure works on closure of the lid 12 to both close any left-open covers 44 and to assure that the covers 44, thus closed, remain closed until selectively opened by the operator. One embodiment for providing this pressure is to place a pad made of a foam-like elastic material under the main lid 12. This pad works like a spring, pushing all the tabs 46 toward the openings of their respective cells.

Accordingly, the underside of the lid 12 is provided with a foam 86 which simultaneously applies pressures to all of the covers 44 in place within the base 14. Other structures instead of foam may be provided for accomplishing the same function, such as a rigid plate. (Of course, because the covers 44 are selectively removable, not all of the cells 26 need be covered at the same time.) Complete closure of the lid 12 applies equal pressure against the covers 44 such that closure of the covers 44 and retention of the closed position is simultaneously assured.

The feature of the inner wall 86 provides important advantages. Because the lid 12 is a relatively large area equal to the height and width of the container (i.e., the largest outer surface), the user will be able to push with his hands or fingers upon the outside face of the lid 12 and effectively snap shut any individual cell covers 44 which might not be completely closed. This is a quick and efficient method for ensuring that all of the covers 44 of the cells 26 are shut properly. In addition, because the finger-operable tabs 46 are all of the same height when snapped into place, any force placed on the lid 12 will naturally be substantially evenly distributed over the several nearest tabs 46 under and adjacent to the area of the downward force, thus avoiding an overload condition on any one of the tabs 46. Accordingly, any partially-open cell covers 44 will be snapped shut, and thereafter the box will have the strength to withstand a significant downward force, such as a good size stack of heavy books placed on top of the face of the container 10, or a large number of the same containers stacked one on top of another. In addition, a sturdy lid 12 effectively protects the much smaller and weaker cell covers 44 from destruction or damage during storage or transport. Thus those skilled in the art will appreciate that the multiple-celled, dual-covered storage container 10 of the present invention is both rugged for its size and is likely to last in service for a relatively long time.

Referring to FIG. 13, a broken away and cross-sectional view of the closed container 10 viewed from the side of one of the hinge assemblies 38 is illustrated. This view is valuable in illustrating the relative positions of the recessed area 24 formed in top side of the lid 12 and one of the feet 54 formed on the underside of the base 14.

In addition, FIG. 13 illustrates the general arrangement of the hinge assembly 38. The sleeve 56 is shown in relation to the lid 12 as well as to the pin or dowel 58.

The foregoing detailed description shows that the preferred embodiments of the present invention are well suited to fulfill the objects above-stated. It is recognized that those skilled in the art may make various modifications or additions to the preferred embodiments chosen to illustrate the present invention without departing from the spirit and proper scope of the invention. For example, the dimensions of the individual cells and the overall dimension of the container may be varied. Also, different arrangements for the cells may be utilized such that, for example, a honeycomb pattern may be utilized. Accordingly, it is to be understood that the protection sought and to be afforded hereby should be deemed to extend to the subject matter defined by the appended claims, including all fair equivalents thereof.

What is claimed is:

1. A container for housing plural components, the container comprising:

a lid defined by a main lid wall and a peripheral lid wall, said peripheral lid wall including a front wall, a pair of opposing side walls, an underside having an integrally-molded cell cover-closing structure formed thereon;

a base including a main base wall and a peripheral base wall, said peripheral base wall including a back wall, a front wall, a bottom wall, and a pair of opposing side walls, said main base wall and said peripheral base wall defining in part an interior space, said lid being positionable upon said base to substantially enclose said interior space;

at least ten component-holding cells formed in said interior space of said base, each of said at least ten component-holding cells including a pair of adjoining side walls, said side walls being common with side walls of two other of said cells, each of said cells further including base wall, said main base wall of said base and said base wall of each of said at least ten component-holding cells being the same, said base and said at least ten component-holding cells being integrally formed;

plural cell covers, each of said cell covers being formed to substantially provide a closure to a respective one of said at least ten component-holding cells, each of said cell covers including a hinge portion for removable attachment to one of said cells, each of said cell covers having a contact region against which said cell cover-closing structure of said lid presses when said lid is moved to its closed position;

whereby said lid encloses said at least ten component-holding cells and said cell covers when said lid is positioned upon said base to substantially enclose said interior space.

2. The container for housing plural components of claim 1, including a hinge assembly for attaching said lid to said base.

3. The container for housing plural components of claim 2, wherein said hinge assembly includes a pin operatively engaged substantially within a sleeve.

4. The container for housing plural components of claim 1, wherein said base has an underside, said underside having at least one foot formed thereon.

5. The container for housing plural components of claim 4, wherein said lid has a top side having at least one foot-receiving recessed area defined therein for cooperative relation with said at least one foot.

6. The container for housing plural components of claim 1, wherein said container further includes means for locking.

7. The container for housing plural components of claim 6, wherein said means for locking comprises a female snap portion and a male snap portion for selective and cooperative engagement with said female snap portion.

8. The container for housing plural components of claim 1, wherein each of said at least ten component-holding cells is defined by a back wall and a front wall.

9. The container for housing plural components of claim 1, wherein said cell cover comprises a body and a finger-operable tab extending from said body.

10. The container for housing plural components of claim 9, including a locking tab extending from said body.

11. The container for housing plural components of claim 10, wherein said cell cover has a recess formed thereon for placement of indicia for identifying the contents of said at least one component-holding cell.

12. The container for housing plural components of claim 11, including a combination hinge-fastener extending from said body of said cell cover.

13. The container for housing plural components of claim 12, wherein said combination hinge-fastener includes a backing plate, said backing plate being attached to said body of said cover by a living hinge.

14. The container for housing plural components of claim 13, wherein each of said at least one component-holding cells is defined by a back wall and a front wall, said back wall having defined therein a pair of spaced apart slots.

15. The container for housing plural components of claim 14, wherein said combination hinge-fastener includes a pair of spaced apart engaging tabs, said tabs being lockably and removably insertable within said pair of spaced apart slots.

16. The container for housing plural components of claim 14, wherein said front wall of each of said at least ten component-holding cells includes a ridge for selective engagement with said locking tab.

17. The container for housing plural components of claim 1, including means for biasing against said cell cover.

18. The container for housing plural components of claim 17, wherein said means for biasing is a foam member.

19. The container for housing plural components of claim 1, wherein said lid and said cell cover are composed of a polymerized material.

20. A container for housing plural components, the container comprising:

a base, said base having an interior space defined in part by a base wall;

a lid operatively associated with said base, said lid being movable between an open position and a closed position, said lid having an underside, said underside having an integrally-molded cell cover-closing structure formed thereon;

plural rows of component-holding cells formed within said interior space of said base, each of said component-holding cells including a side wall that is the same as a side wall of an adjacent one of said cells, a base wall, said base wall of said base and said base wall of said at least one component-holding cell being the same, said base and said at least one component-holding cell being an integrally-formed, continuous piece of a polymerized material;

a plurality of cell covers operatively associated with said component-holding cells, said cell covers including a finger-operable tab extending therefrom, each of said cell covers having a contact region against which said cell cover-closing structure of said lid presses when said lid is moved to its closed position, whereby said lid substantially encloses said component-holding cells and said cell covers when said lid is moved to its closed position.

21. A method for closing individual cell covers within a container having a base and a lid and for maintaining the closed position of the individual cells covers, the method comprising the steps of:

forming a container having a base and a lid operatively associated with said base, said base having a base wall, said lid being movable between a closed position and an opened position;

forming substantially within said base a plurality of rows and columns of individual component-receiving cells, each of said individual component-receiving cells including a base wall, said base wall of said base and said base wall of each of said individual component-receiving cells being the same, said base and said plurality of individual component-receiving cells being an integrally-formed, continuous piece of a polymerized material;

fitting a cell cover to each of at least some of said cells, each of said cell covers being movable between open and close positions;

forming a structure on the underside of said lid for pressing against said cell covers when said lid is moved to said closed position; and moving said lid to its closed position and consequently moving said cell covers to their closed positions.

22. A container for housing plural components, the container comprising:

a lid defined by a main lid wall and a peripheral lid wall, said lid including an underside and an integrally-molded cell cover-closing structure formed thereon;

a base defined by a main base wall and a peripheral base wall, said lid being positionable upon said base, said lid being movable between an open position and a closed position with respect to said base;

a plurality of rows and columns of component-holding cells formed in said interior space of said base, each of said component-holding cells including a base wall that is common with and forms part of said main base wall, said base and each of said component-holding cells being an integrally formed, continuous piece of polymerized material;

a plurality of cell covers, each of said cell covers being defined to substantially provide a closure to its respective component-holding cell, each of said cell covers having a contact region against which said cell cover-closing structure of said lid presses when said lid is moved to its closed position, whereby said lid extends over each of said component-holding cells and their respective cell covers when said lid is moved to its closed position.

* * * * *